US011209002B2

(12) United States Patent
Lanum et al.

(10) Patent No.: US 11,209,002 B2
(45) Date of Patent: Dec. 28, 2021

(54) LUBRICATION SYSTEM FOR A COMPRESSOR

(71) Applicant: Joy Global Surface Mining Inc, Milwaukee, WI (US)

(72) Inventors: Michael D. Lanum, Kenosha, WI (US); Scott McMahon, Wauwatosa, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 207 days.

(21) Appl. No.: 16/123,487

(22) Filed: Sep. 6, 2018

(65) Prior Publication Data

US 2019/0072095 A1 Mar. 7, 2019

Related U.S. Application Data

(60) Provisional application No. 62/554,838, filed on Sep. 6, 2017.

(51) Int. Cl.
*F04C 29/02* (2006.01)
*F04C 18/16* (2006.01)
*F04C 27/02* (2006.01)

(52) U.S. Cl.
CPC ..... *F04C 29/021* (2013.01); *F04C 18/16* (2013.01); *F04C 27/02* (2013.01); *F04C 29/025* (2013.01);
(Continued)

(58) Field of Classification Search
CPC ..... F04C 18/16; F04C 27/02; F04C 29/021; F04C 29/025; F04C 29/026;
(Continued)

(56) References Cited

U.S. PATENT DOCUMENTS 3,936,249 A * 2/1976 Sato ..... F04C 29/0007 418/88
4,262,775 A * 4/1981 Webb ..... F01M 1/16 137/115.26
(Continued)

FOREIGN PATENT DOCUMENTS

CN 102996455 A 3/2013
CN 211231353 U 8/2020
(Continued)

OTHER PUBLICATIONS

Chilean Patent Office Search Report for Application No. 201802552 dated Mar. 16, 2020 (16 pages including statement of relevance).
(Continued)

*Primary Examiner* — Charles G Freay
*Assistant Examiner* — Joseph S. Herrmann
(74) *Attorney, Agent, or Firm* — Michael Best and Friedrich LLP

(57) ABSTRACT

An oil flooded screw compressor includes a housing with an inlet and an outlet, and a rotor supported within the housing by a bearing. The rotor is rotatable to compress air from the inlet to the outlet when the compressor is in an operating state, and the rotor is rotatable without compressing air when the compressor is in an idle state. The compressor also includes a pump configured to supply oil to the bearing only when the compressor is in the idle state.

14 Claims, 8 Drawing Sheets

(52) U.S. Cl.
CPC ..... *F04C 29/026* (2013.01); *F04C 2240/52* (2013.01); *F05B 2260/98* (2013.01)

(58) Field of Classification Search
CPC ..... F04C 2240/52; F05B 2260/98; F04B 39/027; F01M 1/00; F01M 1/02; F01C 21/04; F01C 21/045
USPC ..... 417/228
See application file for complete search history.

(56) References Cited

U.S. PATENT DOCUMENTS

| | | | | |
|---|---|---|---|---|
| 4,394,113 | A * | 7/1983 | Bammert | F04C 29/02 418/201.2 |
| 4,964,790 | A * | 10/1990 | Scott | F04C 29/0021 418/1 |
| 6,860,730 | B2 * | 3/2005 | Leppanen | F04B 23/08 417/440 |
| 6,981,855 | B2 * | 1/2006 | Leppanen | F04C 18/16 418/201.1 |
| 8,046,990 | B2 | 11/2011 | Bollinger et al. | |
| 8,512,019 | B2 * | 8/2013 | Kakiuchi | F04C 18/16 418/98 |
| 10,197,316 | B2 | 2/2019 | Da Larminat et al. | |
| 10,273,962 | B2 | 4/2019 | Mate et al. | |
| 10,851,941 | B2 | 12/2020 | Wilson et al. | |
| 2008/0085207 | A1 | 4/2008 | Mosemann et al. | |
| 2008/0206085 | A1 * | 8/2008 | Zieglgansberger | F04C 29/02 418/85 |
| 2011/0314830 | A1 * | 12/2011 | Legare | F01D 25/20 60/772 |
| 2016/0040491 | A1 | 2/2016 | Law et al. | |
| 2019/0072093 | A1 * | 3/2019 | Tajima | F04C 29/0007 |
| 2019/0120369 | A1 | 4/2019 | Staake et al. | |

FOREIGN PATENT DOCUMENTS

| | | | |
|---|---|---|---|
| DE | 102006034721 | A1 | 1/2008 |
| EP | 464315 | B1 | 6/1993 |
| ES | 2362621 | T3 | 7/2011 |
| MX | 2017010212 | A | 11/2017 |
| RU | 2445513 | * | 3/2012 |
| WO | 2009030471 | A1 | 3/2009 |

OTHER PUBLICATIONS

Chilean Examination Report for Application No. 201802552 dated Nov. 13, 2019 (4 pages).
Sandvik Mining, "Reduce Environmental Impact This Way! Compressor Management System", Brochure, 2012, 5 pages.
Fiscor, "New System Manages Main Compressor on Rotary Drills", Coal Age, 2011, 4 pages.

* cited by examiner

LUBRICATION SYSTEM FOR A COMPRESSOR

CROSS-REFERENCE TO RELATED APPLICATIONS

This application claims priority to co-pending U.S. Provisional Patent Application No. 62/554,838, filed on Sep. 6, 2017, the entire content of which is incorporated herein by reference.

FIELD OF THE DISCLOSURE

The present disclosure relates to compressors, and more particularly to lubrication systems for oil flooded screw compressors.

BACKGROUND OF THE DISCLOSURE

Oil flooded screw compressors typically include a set of rotors or screws that require oil to seal between the rotors and to remove heat generated during compression. The rotors are supported on bearings that also typically require oil for lubrication. Often, the required oil is supplied by the compressor's air/oil separator tank. Pressurized air discharged from the compressor flows into the separator tank, where entrained oil is separated from the air and collected in the tank. As such, the separator tank is maintained at an elevated pressure when the compressor is operating. The pressurized separator tank then supplies oil to the desired areas of the compressor.

Maintaining pressure in the separator tank puts a constant load on the compressor when it is operating, even when the compressor is not being used for work downstream (e.g., when the compressor is in a standby mode). This load can be eliminated if the separator tank is depressurized. Without pressure in the separator tank, oil will not flow to the rotors or to the rotor bearings. Even though the rotors do not require oil for sealing and heat removal when the separator tank is depressurized (and the load removed from the compressor), the rotor bearings do still require oil to avoid degradation as the rotors continue to spin. Therefore, a need exists for lubrication system that can supply oil to the rotor bearings even when the separator tank is depressurized.

SUMMARY OF THE DISCLOSURE

The present disclosure provides, in one aspect, an oil flooded screw compressor including a housing with an inlet and an outlet, and a rotor supported within the housing by a bearing. The rotor is rotatable to compress air from the inlet to the outlet when the compressor is in an operating state, and the rotor is rotatable without compressing air when the compressor is in an idle state. The compressor also includes a pump configured to supply oil to the bearing only when the compressor is in the idle state.

The present disclosure provides, in another aspect, an oil flooded screw compressor including a housing, a rotor supported within the housing by a bearing, a separator tank configured to separate oil from air compressed by the rotor, and a pump fluidly coupled to the separator tank to pump oil out of the separator tank. The separator tank is configured to supply oil to the bearing along a first fluid path when the separator tank is pressurized, and the pump is configured to supply oil to the bearing along a second fluid path different than the first path when the separator tank is depressurized.

The present disclosure provides, in another aspect, a lubrication system for an oil flooded screw compressor having a housing and a rotor supported within the housing by a bearing. The lubrication system includes a separator tank, a pump, a first line configured to supply oil from the separator tank to the bearing when the separator tank is pressurized, and a second line configured to supply oil from the pump to the bearing when the separator tank is depressurized.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

Figure 1:
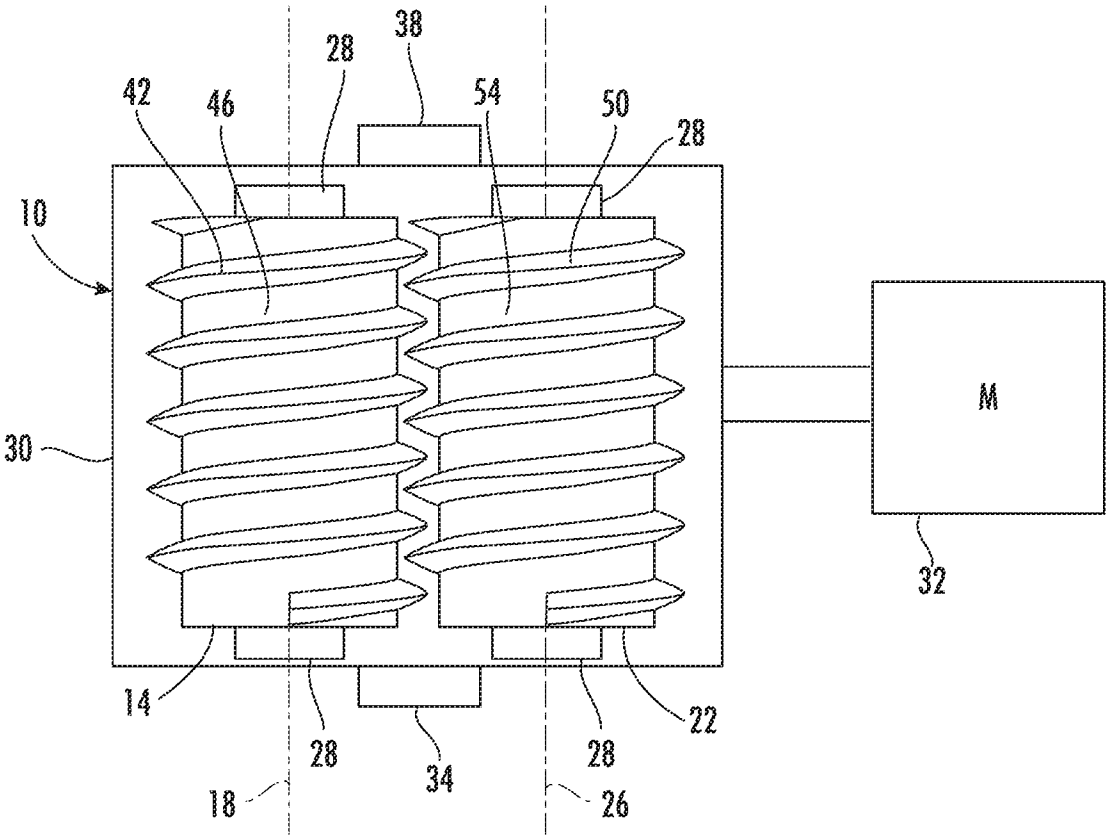
FIG. 1 is a schematic view of an air compressor.

FIG. 1 illustrates an oil flooded rotary screw air compressor 10 including a main rotor or screw 14 that rotates about an axis 18 and a secondary rotor or screw 22 that rotates about an axis 26. The rotors 14, 22 are each supported on low-friction bearings 28 and disposed in a stator housing 30. The rotors 14, 22 are driven by a prime mover 32, such as an engine or an electric motor. The rotors 14, 22 may be coupled to the prime mover 32 by any suitable power transfer mechanism, such as a transmission, power take-off shaft, torque converter, direct drive, and the like. In other embodiments, the compressor 10 may include more than two rotors, or the compressor 10 may include a single rotor.

With continued reference to FIG. 1, the stator housing 30 includes an air inlet port 34 and an air outlet port 38. The main rotor 14 has helical lobes 42 and grooves 46 along its length, while the secondary rotor 22 has corresponding helical lobes 50 and grooves 54. Air flowing in through the inlet port 34 fills spaces between the helical lobes 42, 50 on each rotor 14, 22. Rotation of the rotors 14, 22 causes the air to be trapped between the lobes 42, 50 and the stator housing 30. As rotation continues, the lobes 42 on the main rotor 14 roll into the grooves 54 on the secondary rotor 22 and the lobes 50 on the secondary rotor 22 roll into the grooves 46 on the main rotor 14, thereby reducing the space occupied by the air and resulting in increased pressure. Compression continues until the inter-lobe spaces are exposed to the air outlet port 38 where the compressed air is discharged.

The illustrated compressor 10 is a single stage compressor; however, in other embodiments, the compressor 10 may have multiple stages. In some embodiments, the compressor 10 has a maximum output pressure at the air outlet port 38 of 500 psi. In other embodiments, the compressor 10 has a maximum output pressure at the air outlet port 38 less than 500 psi. In other embodiments, the compressor 10 has a maximum output pressure at the air outlet port 38 between 200 psi and 500 psi. In some embodiments, the compressor 10 has a maximum discharge volume of 3,800 cubic feet per minute (CFM). In other embodiments, the compressor 10 has a maximum discharge volume less than 3,800 CFM. In other embodiments, the compressor 10 has a maximum discharge volume between 1,000 CFM and 3,800 CFM.

Figure 2:
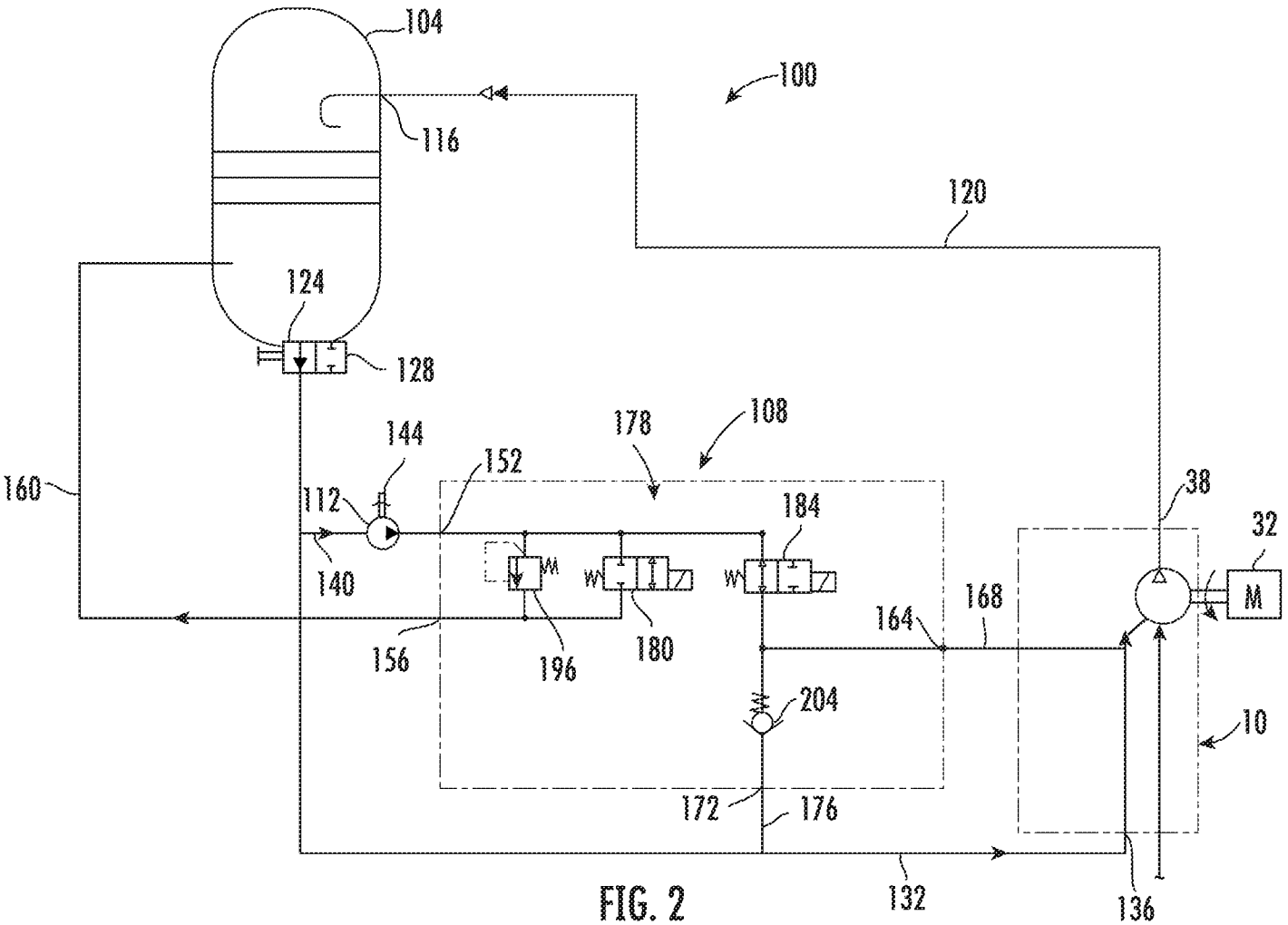
FIG. 2 is a schematic view of a lubrication system according to an embodiment of the disclosure, usable in conjunction with the air compressor of FIG. 1.

FIG. 2 illustrates a lubrication system 100, according to one embodiment, that can be used to supply oil to the compressor 10 illustrated in FIG. 1. As used herein, the term "oil" encompasses any liquid lubricant, whether petroleum based or synthetic, that is appropriate for use in a flooded compressor, such as the compressor 10. The illustrated lubrication system 100 includes an air/oil separator tank 104, a distribution manifold 108, and a pump 112. These components are coupled together by fluid transfer components, such as piping, valving, and/or metering devices. Examples of these fluid transfer components are described below; however, it should be understood that the arrangement, selection, and number of fluid transfer components may be varied as would be understood by one of ordinary skill in the art.

With continued reference to FIG. 2, the separator tank 104 has an inlet 116 coupled to the air outlet port 38 of the compressor 10 by a line 120. A check valve (not shown) may be provided along line 120 in order to prevent backflow from the separator tank 104 to the air outlet port 38 of the compressor 10. The separator tank 104 also includes a working air outlet (not shown) located proximate the top of the separator tank 104 and an oil outlet 124 located proximate the bottom of the tank 104. One or more dump valves (not shown) may also be provided on the separator tank 104. In the illustrated embodiment, a supply valve 128 is provided at the oil outlet 124 to selectively allow or stop a flow of oil from the separator tank 104. An oil supply line 132 extends from the supply valve 128 to supply oil from the separator tank 104 to a rotor oil inlet port 136 on the compressor 10.

The pump 112 is located along a branch line 140 coupled to the oil supply line 132. The pump 112 can be a gear pump, geroter pump, or any other suitable type of oil pump. In the illustrated embodiment, the pump 112 includes a drive shaft 144 for supplying power to the pump 112. The drive shaft 114 can be coupled, directly or indirectly, to the prime mover 32, the compressor 10, or any suitable point in the drivetrain between the prime mover 32 and the compressor 10 to transmit power to the pump 112. As such, the pump 112 is configured to operate and pump oil whenever the rotors 14, 22 of the compressor 10 are spinning. In other embodiments, the pump 112 may be driven hydraulically, pneumatically, or electronically (e.g., via an electric motor as described below with reference to FIG. 5).

Figure 3A:
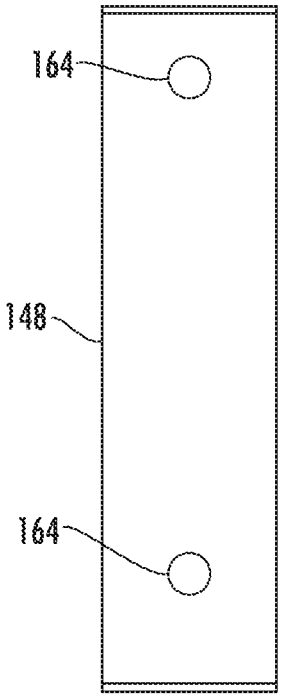
FIGS. 3A-C illustrate an oil distribution manifold of the lubrication system of FIG. 2.
Figure 3B:
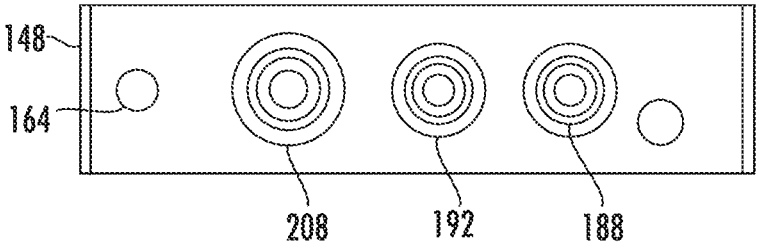
Figure 3C:
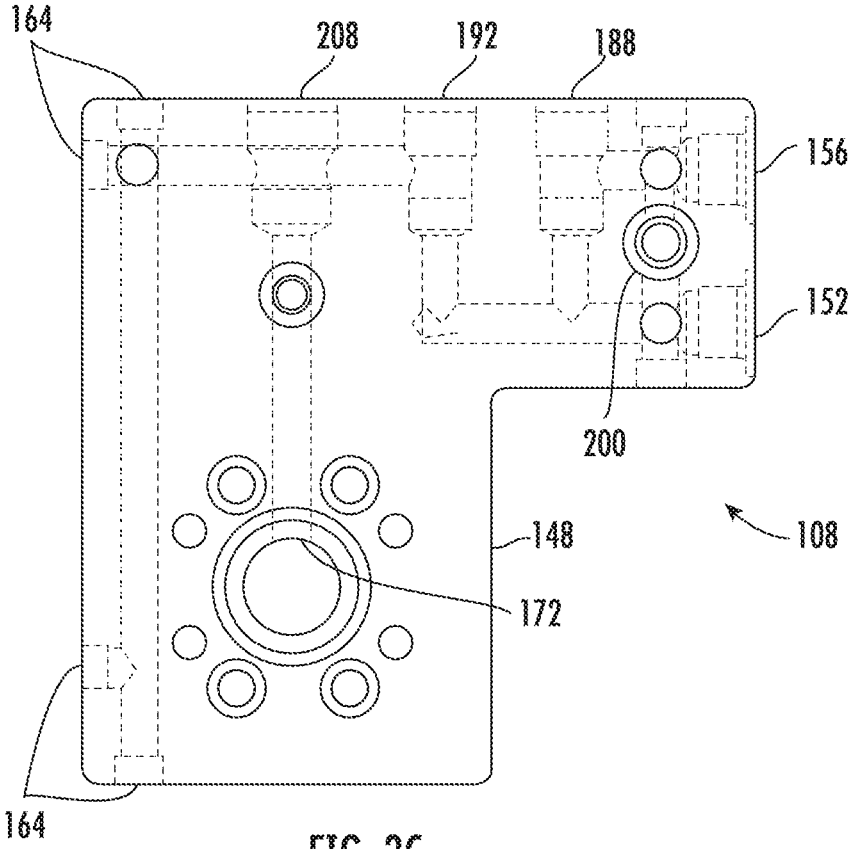

Referring to FIGS. 3A-C, the illustrated manifold 108 includes a main body 148. In the illustrated embodiment, the main body 148 is generally L-shaped and can be formed from a single piece of material (e.g., aluminum, cast iron, steel, magnesium, etc.) by casting. In other embodiments, the main body 148 may include multiple pieces joined together in any suitable manner and may be formed by other methods. In addition, the main body 148 may have any other shape to suit a particular application. The main body 148 includes an inlet port 152 coupled to the branch line 140 on the discharge side of the pump 112, a return port 156 coupled to the separator tank 104 via a return line 160, and a plurality of bearing feed ports 164, each coupled to a respective one of the rotor bearings 28 by one or more bearing oil lines 168 (FIG. 2). The main body 148 also includes a bypass port 172 coupled to the oil supply line 132 by a bypass line 176.

The manifold 108 includes a valve assembly 178 to control the flow of oil through the manifold 108. The inlet port 152 is coupled to the return port 156 via a first diverter valve 180 of the valve assembly 178, and the inlet port 152 is coupled to the bearing feed ports 164 via a second diverter valve 184 of the valve assembly 178 (FIG. 2). The first and second diverter valves 180, 184 are preferably cartridge-style, solenoid-actuated diverter valves housed within first and second valve receptacles 188, 192 that are integrally formed within the main body 148 (FIG. 3C). In the illustrated embodiment, the diverter valves 180, 184 are electronically controlled; however, in other embodiments, the diverter valves 180, 184 may be pneumatically or hydraulically controlled.

The illustrated valve assembly 178 also includes a pressure relief valve 196 provided between the inlet port 152 and the return port 156 in parallel with the first diverter valve 180 to automatically open a flow path from the inlet port 152 to the return port 156 if pressure at the inlet port 152 exceeds a predetermined cracking pressure (e.g., if the pump 112 or the diverter valves 180, 184 malfunction). The pressure relief valve 196 is disposed in a receptacle 200 integrally formed within the main body 148. The bearing feed ports 164 are coupled to the bypass port 172 via a check valve 204 of the valve assembly 178 to permit oil to flow from the oil supply line 132 to the bearing feed ports 164 when the oil supply line 132 is pressurized above a predetermined cracking pressure of the check valve 204 (i.e. when the separator tank 104 is pressurized during operation of the compressor 10). The check valve 204 is preferably a cartridge-style check valve housed within a receptacle 208 integrally formed within the main body 148. In some embodiments, other types of valves may be used, and the first and second diverter valves 180, 184, the pressure relief valve 196, and/or the check valve 204 may be located outside of the main body 148 of the manifold 108.

Figure 4:
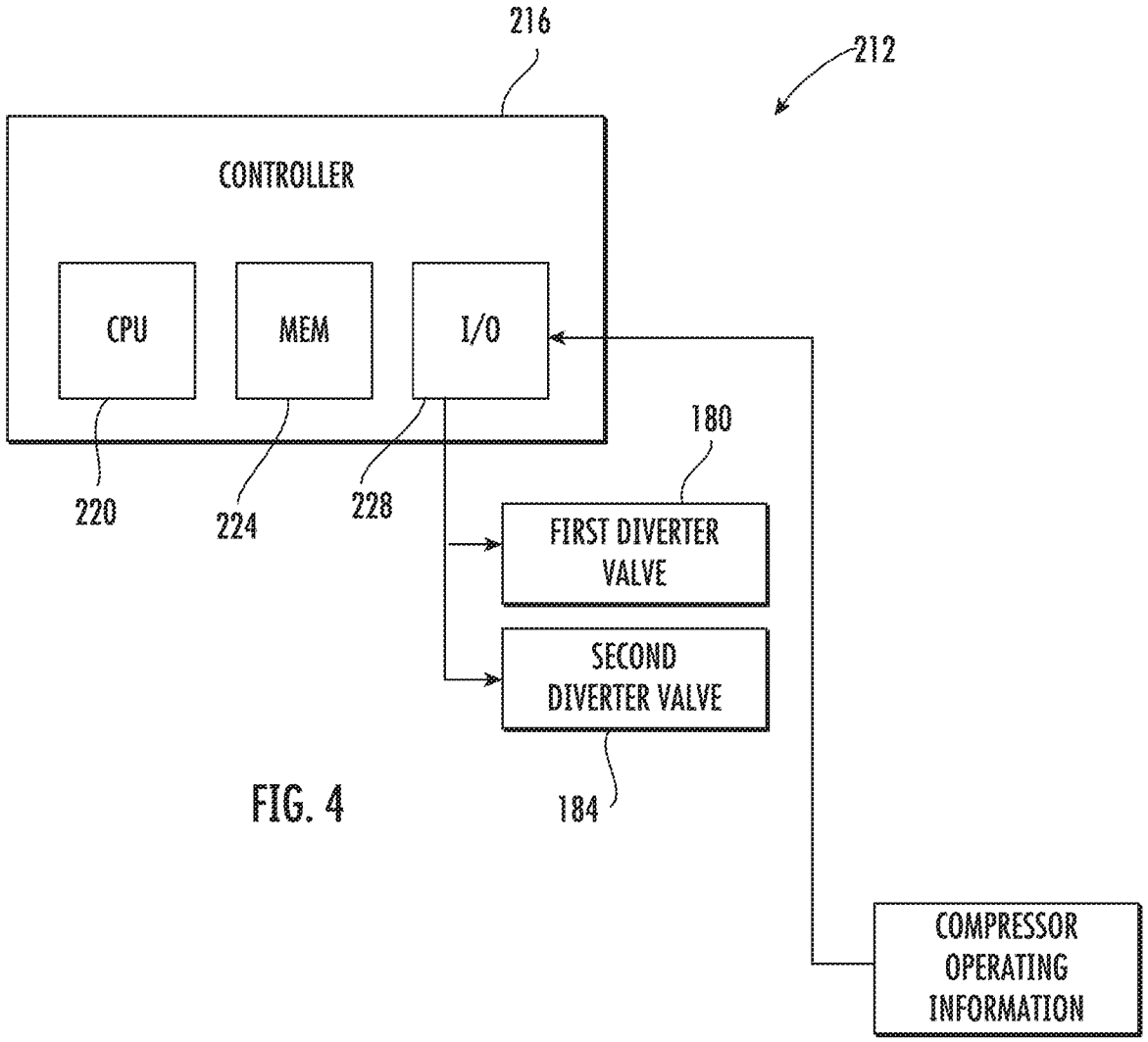
FIGS. 4 and 4A are schematic views of a control system of the lubrication system of FIG. 2 and of a control system of the lubrication system of FIG. 5, respectively.
Figure 4A:
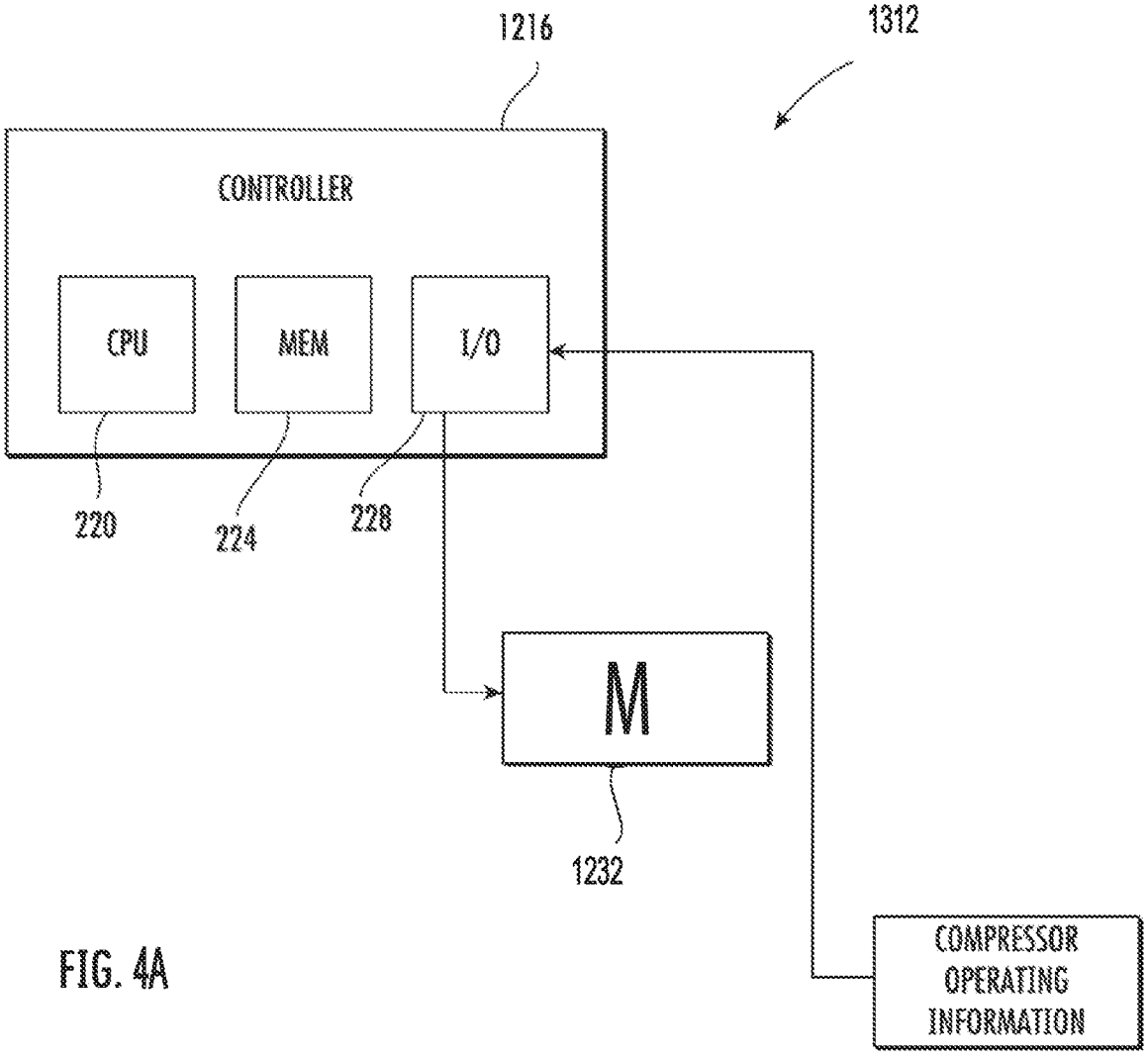

With reference to FIG. 4, the lubrication system 100 includes a control system 212 for controlling operation of the lubrication system 100. The control system 212 may be integrated into one or more control systems of the compressor 10 or may be a standalone system that may communicate with a control system of the compressor 10. The control system 212 includes a controller 216 having a plurality of electrical and electronic components that provide power, operational control, and protection to the components and modules within the controller 216. For example, the controller 216 may include an electronic processor or central processing unit 220 (e.g., a programmable microprocessor, microcontroller, or similar device), non-transitory, machine-readable memory 224, and an input/output interface 228. Software included in the implementation of the controller 216 can be stored in the memory 224. The software includes, for example, firmware, one or more applications, program data, filters, rules, one or more program modules, and other executable instructions. The controller 216 is configured to retrieve from memory 224 and execute, among other things, instructions related to the control processes and methods described herein. In other embodiments, the controller 216 may include additional, fewer, or different components.

The controller 216 is communicatively coupled to the first and second diverter valves 180, 184 (e.g., via the input/output interface 228) to control their operation. The controller 216 is also communicatively coupled to the compressor 10 (e.g., via a control system of the compressor 10 or one or more sensors configured to monitor operation of the compressor 10) to receive compressor operating information. The compressor operating information may indicate, among other things, whether the compressor 10 is in an operating state or a stand-by state. In some embodiments, the controller 216 may operate the lubrication system 100 automatically, with no or minimal operator input. The controller 216 may communicate with any of the connected electric or electronic components of the system 100 via wired connection, wireless connection, or a combination of wired and wireless connections. In other embodiments, the controller 216 may communicate with the valve assembly 178 or other components of the system 100 via hydraulic or pneumatic pressure signals. For example, the input/output interface 228 may include one or more fluid lines coupled to the first and second diverter valves 180, 184, and the controller 216 may selectively route pressurized fluid through the fluid lines to actuate the valves 180, 184.

In operation, when the compressor 10 is in an operating state, the separator tank 104 is pressurized and oil flows through the oil outlet 124, the supply valve 128, and into the oil supply line 132. The oil supply line 132 routes oil into the rotor oil inlet port 136, such that oil is injected into the stator housing 30. The oil lubricates the intermeshing rotors 14, 22 and provides an air seal between the rotors 14, 22 during compression. The oil supply line 132 also supplies oil to the pump 112. The controller 216 maintains the first diverter valve 180 in an open position and the second diverter valve 184 in a closed position. As such, the manifold 108 routes the flow of oil generated by the pump 112 from the inlet port 152 to the return port 156, and ultimately back to the separator tank 104 via the return line 160. Thus, the bearings 28 do not receive oil from the pump 112 when the compressor 10 is in its operating state. Rather, the pressure in the oil supply line 132 opens the check valve 204, allowing oil to flow through the bypass line 176, to the bearing feed ports 164, and to the bearings 28 via the bearing oil lines 168. Looping the flow of oil from the pump 112 back to the separator tank 104 advantageously prevents over-lubrication of the bearings 28 when the compressor 10 is in the operating state. In addition, no clutch or torque-interrupter is required between the pump 112 and the compressor 10 or prime mover 32.

When the compressor 10 is in a stand-by or idle state, the separator tank 104 is depressurized. For example, the controller 216 may depressurize the separator tank 104 by opening one or more solenoid-actuated dump valves when the controller 216 determines that the compressor 10 is in the stand-by state. Depressurizing the separator tank 104 advantageously reduces the idle load on the compressor 10, which in turn reduces the fuel or energy required by the prime mover 32. Without elevated pressure in the separator tank 104, oil is not forced through the oil supply line 132 to the rotor oil inlet port 136, and the check valve 204 moves to a closed position. The pump 112, however, continues to draw oil from the separator tank 104. The controller 216 maintains the first diverter valve 180 in a closed position and the second diverter valve 184 in an open position when the separator tank 104 is depressurized (i.e. when a pressure within the separator tank 104 falls below a predetermined pressure). As such, the manifold 108 routes the flow of oil generated by the pump 112 from the inlet port 152 to the bearing feed ports 164, and ultimately to the bearings 28 via the bearing oil lines 168. Thus, oil is continuously supplied to the bearings 28 when the separator tank 104 is depressurized and the compressor 10 is in the stand-by state.

Figure 5:
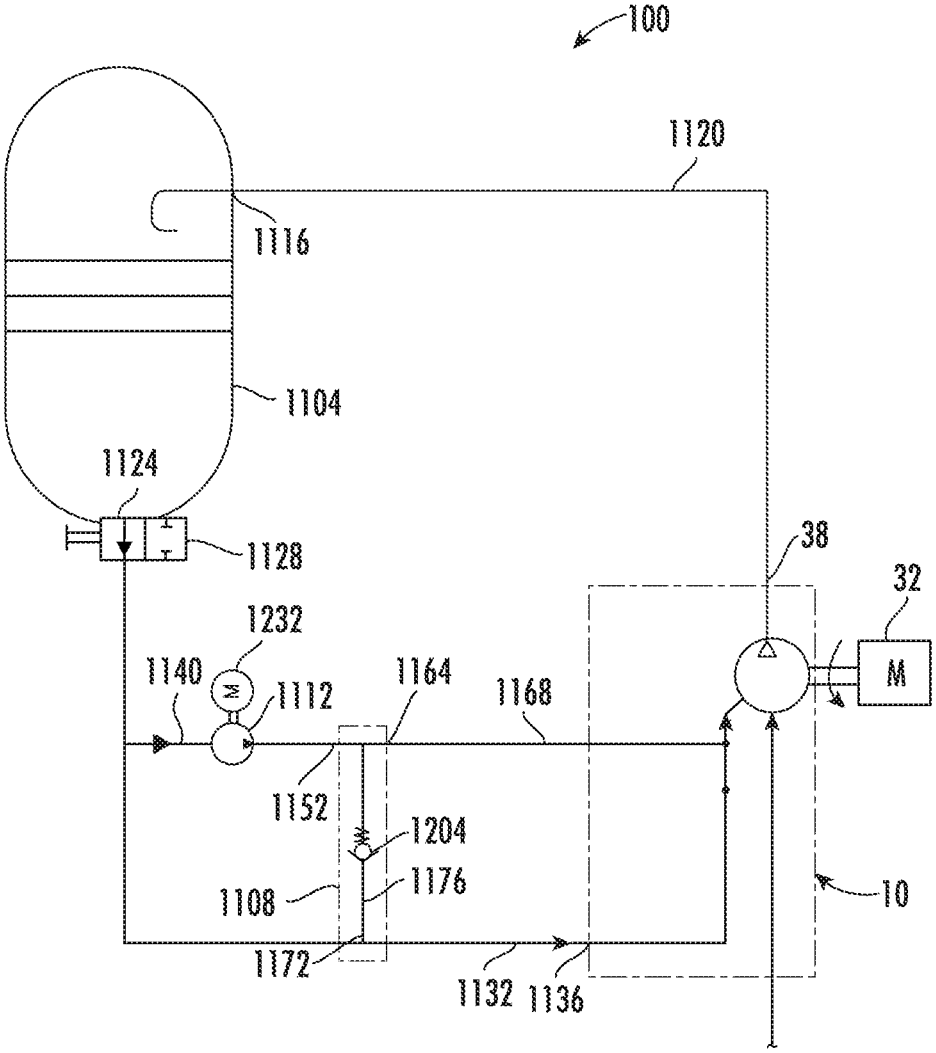
FIG. 5 is a schematic view of a lubrication system according to another embodiment of the disclosure, usable in conjunction with the air compressor of FIG. 1.

FIG. 5 illustrates a lubrication system 1100 according to another embodiment. The lubrication system 1100 is similar to the lubrication system 100 described above with reference to FIGS. 1-4, and features and components of the lubrication system 1100 corresponding with features and components of the lubrication system 100 are given like reference numbers plus 1000. In addition, only differences between the lubrication system 1100 and the lubrication system 100 are described in detail herein.

The pump 1112 in the illustrated embodiment of the lubrication system 1100 is powered by an electric motor 1232 rather than by a mechanical connection with the drivetrain of the compressor 10. The controller 1216 is in communication with the motor 1232 to selectively energize or de-energize the motor 1232. As such, the manifold 1108 does not need to loop the flow of oil from the pump 1112 when the compressor 10 is in the operating state. The manifold 1108 therefore includes only the check valve 1204. In other embodiments, the motor 1232 may be a hydraulic motor, and the controller 1216 may activate or de-activate the motor 1232 by controlling a flow of hydraulic fluid through the motor 1232.

In operation, when the compressor 10 is in an operating state, the separator tank 1104 is pressurized and oil flows through the oil outlet 1124, the supply valve 1128, and into the oil supply line 1132. The oil supply line 1132 routes oil into the rotor oil inlet port 1136, such that oil is injected into the stator housing 30. The oil lubricates the intermeshing rotors 14, 22 and provides an air seal between the rotors 14, 22 during compression. The controller 1216 maintains the pump 1112 in a de-energized state. Thus, the bearings 28 do not receive oil from the pump 1112 when the compressor 10 is in its operating state. Rather, the pressure in the oil supply line 1132 opens the check valve 1204, allowing oil to flow through the bypass line 1176, to the bearing feed ports 1164, and to the bearings 28 via the bearing oil lines 1168.

When the compressor 10 is in a stand-by or idle state, the separator tank 1104 is depressurized. For example, the controller 1216 may depressurize the separator tank 1104 by opening one or more solenoid-actuated dump valves when the controller 1216 determines that the compressor 10 is in the stand-by state. Depressurizing the separator tank 1104 advantageously reduces the idle load on the compressor 10, which in turn reduces the fuel or energy required by the prime mover 32. Without elevated pressure in the separator tank 1104, oil is not forced through the oil supply line 1132 to the rotor oil inlet port 1136, and the check valve 1204 moves to a closed position. The controller 1216 energizes the pump 1112, however, to draw oil from the separator tank 104 when the separator tank 1104 is depressurized (i.e. when the pressure within the separator tank 1104 is below a predetermined level). As such, the manifold 1108 routes the flow of oil generated by the pump 1112 from the inlet port 1152 to the bearing feed ports 1164, and ultimately to the bearings 28 via the bearing oil lines 1168. Thus, oil is continuously supplied to the bearings 28 when the separator tank 1104 is depressurized and the compressor 10 is in the stand-by state.

Figure 6:
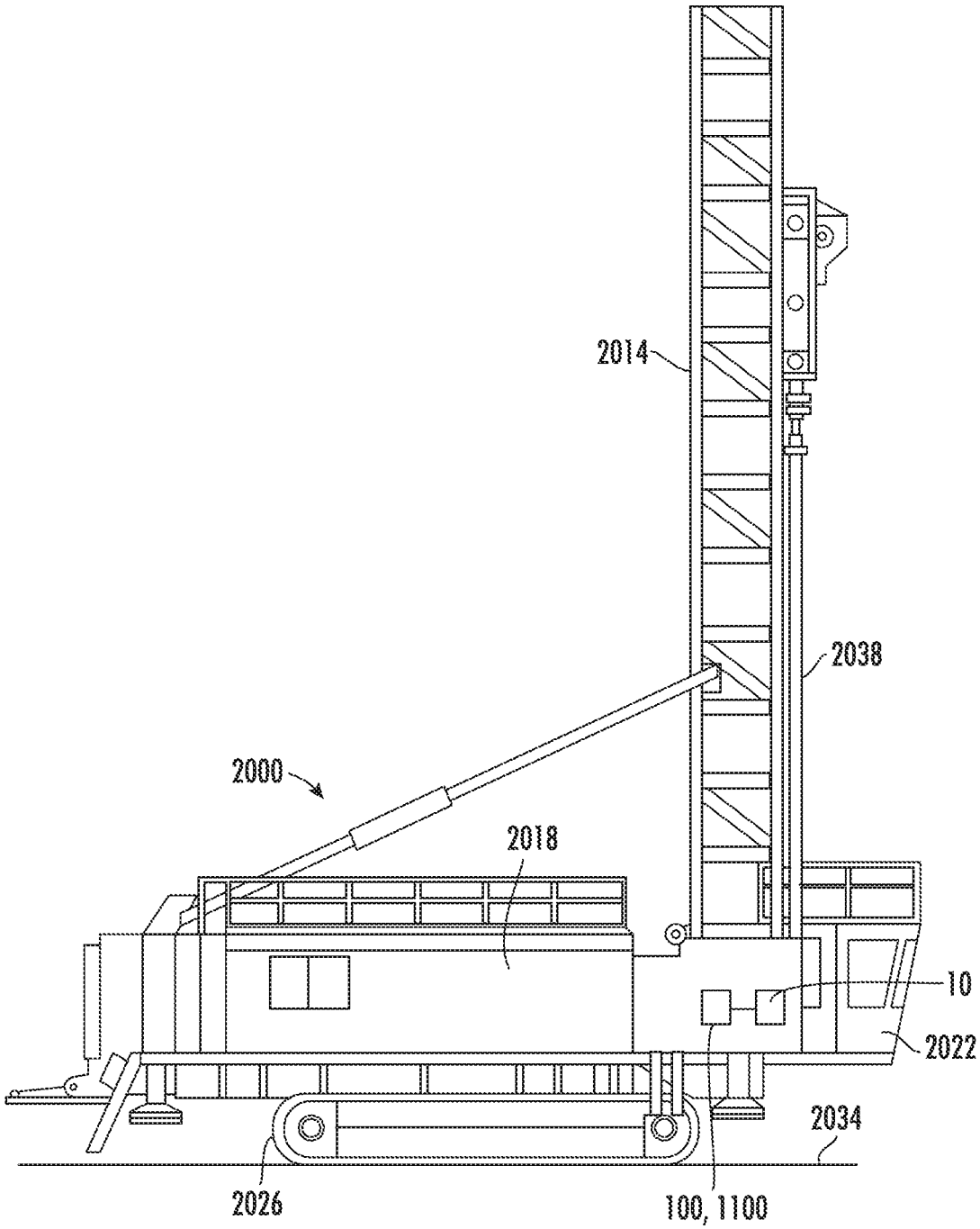
FIG. 6 illustrates a machine incorporating the air compressor of FIG. 1 and the lubrication system of FIG. 2 or FIG. 5.

FIG. 6 illustrates a machine 2000 that incorporates the compressor 10 and one of the lubrication systems 100, 1100. The illustrated machine 2000 is a blasthole drill; however, in other embodiments, the machine 2000 may be a different type of drill or any other type of machine requiring compressed air, including mining equipment, construction equipment, and the like. The illustrated blasthole drill 2000 includes a drill tower 2014, a base 2018 (e.g., a machinery house) beneath the drill tower 2014 that supports the drill tower 2014, an operator's cab 2022 coupled to the base 2018, and crawlers 2026 configured to drive the drill 2000 along a ground surface 2034. The drill tower 2014 is coupled to and supports a drill pipe 2038 (e.g., with a drill bit, not shown), which is configured to extend vertically downward through the ground 2034 and into a borehole.

The air compressor 10 is supported by the base 2018 and is operable to generate compressed air that may be used, for example, for flushing bit cuttings from the bottom of the borehole to the surface. The lubrication system 100, 1100 is supported by the base 2018 and is operable to provide oil to the rotors 14, 22 and bearings 28 as discussed above.

Various features of the disclosure are set forth in the following claims.

What is claimed is:

1. An oil flooded screw compressor and lubrication system comprising:

a separator tank;

a housing including an inlet and an outlet;

a rotor of the oil flooded screw compressor supported within the housing by a bearing;

a prime mover that drives the rotor;

wherein the rotor is driven by the prime mover to compress air from the inlet to the outlet while the oil flooded screw compressor is in an operating state such that the outlet and the separator tank are pressurized with the compressed aft during the operating state of the oil flooded screw compressor;

wherein the separator tank is configured to separate oil from the air compressed by the rotor;

wherein the oil flooded screw compressor is operable in an idle state in which the outlet and the separator tank are depressurized, and wherein the rotor is driven by the prime mover while the oil flooded screw compressor is in the idle state;

a pump that supplies oil from the pump to the bearing only while the oil flooded screw compressor is in the idle state; and a controller that controls flow of the oil between the separator tank and the bearing such that the oil is continuously supplied to the bearing when the separator tank is depressurized and the oil flooded screw compressor is in the idle state.

2. The oil flooded screw compressor and lubrication system of claim 1, wherein the pump is fluidly coupled to the separator tank to draw the oil from the separator tank.

3. The oil flooded screw compressor and lubrication system of claim 1, further comprising a valve assembly configured to direct the oil from the pump to the bearing while the compressor is in the idle state.

4. The oil flooded screw compressor and lubrication system of claim 3, wherein the valve assembly is configured to direct the oil from the pump to the separator tank while the compressor is in the operating state, bypassing the bearing.

5. The oil flooded screw compressor and lubrication system of claim 3, wherein the valve assembly includes a solenoid-actuated diverter valve.

6. The oil flooded screw compressor and lubrication system of claim 1, further comprising a motor coupled to the pump, wherein the controller is configured to energize the motor while the compressor is in the idle state, and to de-energize the motor while the compressor is in the operating state.

7. The oil flooded screw compressor and lubrication system of claim 1, wherein the pump is coupled to the prime mover such that the prime mover drives the pump while the compressor is in the idle state and while the compressor is in the operating state.

8. The oil flooded screw compressor and lubrication system of claim 1, wherein the rotor is one of a plurality of rotors, wherein the bearing is one of a plurality of bearings supporting the plurality of rotors, and wherein the oil flooded screw compressor and lubrication system further comprises a manifold disposed fluidly between the pump and the plurality of bearings.

9. The oil flooded screw compressor and lubrication system of claim 1, wherein the oil is supplied into the housing and to the rotor to form a seal with the rotor while the compressor is in the operating state, and wherein the oil is not supplied to the rotor while the compressor is in the idle state.

10. An oil flooded screw compressor and lubrication system comprising:

a housing;

a rotor supported within the housing by a bearing;

a separator tank configured to separate oil from air compressed by the rotor;

a pump fluidly coupled to the separator tank and configured to pump the oil out of the separator tank; and a valve assembly configured to selectively direct oil from the pump to the bearing, wherein the separator tank is configured to supply the oil to the bearing along a first fluid path while the separator tank is pressurized, wherein the pump is configured to supply the oil from the pump to the bearing along a second fluid path different than the first path while the separator tank is depressurized, wherein the oil supplied to the bearing along the first fluid path bypasses the pump, and wherein the valve assembly is configured to direct the oil from the pump to the separator tank, bypassing the bearing, while the separator tank is pressurized.

11. The oil flooded screw compressor and lubrication system of claim 10, wherein the rotor is one of a plurality of rotors, wherein the bearing is one of a plurality of bearings supporting the plurality of rotors, and wherein the oil flooded screw compressor and lubrication system further comprises a manifold disposed fluidly between the pump and the plurality of bearings.

12. A lubrication system for an oil flooded screw compressor having a housing and a rotor supported within the housing by a bearing, the lubrication system comprising:

a separator tank;

a pump;

a first line configured to supply oil from the separator tank to the bearing while bypassing the pump while the separator tank is pressurized;

a second line configured to supply oil from the pump to the bearing while the separator tank is depressurized;

a third line extending between the pump and the separator tank; and a controller in communication with a valve assembly;

wherein the controller is configured to actuate the valve assembly to direct the oil from the pump into the third line while the separator tank is pressurized.

13. The lubrication system of claim 12, further comprising a manifold fluidly coupled to the separator tank, the pump, the first line, the second line, and the third line;

wherein the valve assembly is disposed within the manifold.

14. The lubrication system of claim 12, wherein the valve assembly includes a plurality of solenoid-actuated diverter valves.

* * * * *